US006338170B1

(12) United States Patent
De Simone

(10) Patent No.: US 6,338,170 B1
(45) Date of Patent: Jan. 15, 2002

(54) HAND-HELD OR FIXED MASSAGE SHOWER

(76) Inventor: Fiorentino De Simone, Largo Olgiata 15, Isola 2/E, I-00123 Rome (IT)

( * ) Notice: Subject to any disclaimer, the term of this patent is extended or adjusted under 35 U.S.C. 154(b) by 0 days.

(21) Appl. No.: 09/617,503

(22) Filed: Jul. 17, 2000

Related U.S. Application Data

(63) Continuation-in-part of application No. PCT/IT99/00005, filed on Jan. 15, 1999.

(30) Foreign Application Priority Data

Jan. 16, 1998 (IT) ..... RM98A0021

(51) Int. Cl.[7] ..... A47K 7/02
(52) U.S. Cl. ..... 4/606; 601/114
(58) Field of Search ..... 4/606; 15/29; 601/112, 601/113, 114, 154, 155, 160

(56) References Cited

U.S. PATENT DOCUMENTS

| | | | | |
|---|---|---|---|---|
| 398,514 A | * | 2/1889 | Kitchen | 4/606 |
| 2,026,981 A | * | 1/1936 | Kahnt | 4/606 |
| 3,563,469 A | | 2/1971 | Stacey | 239/383 |
| 4,432,355 A | | 2/1984 | Delluc | 15/29 X |
| 4,967,965 A | | 11/1990 | Kragle | 239/548 |
| 5,065,463 A | | 11/1991 | Le | 4/606 |
| 5,385,532 A | | 1/1995 | Shyu | 15/29 X |

FOREIGN PATENT DOCUMENTS

| | | |
|---|---|---|
| CH | 328 897 | 3/1998 |
| DE | 38 27 286 | 2/1990 |
| DE | 94 02 435 | 4/1994 |
| DE | 295 02 720 | 3/1996 |
| EP | 0 348 359 | 12/1989 |
| FR | 1 031 585 | 6/1953 |

* cited by examiner

*Primary Examiner*—Robert M. Fetsuga
(74) *Attorney, Agent, or Firm*—Young & Thompson

(57) ABSTRACT

A water-driven whirl shower fixture including one or more spouts and one or more sponges, rolls or similar interchangeable massaging means which can be handled by the user and/or hung on the wall or the bathtub.

Said water-driven fixture for having a water massage and/or a shower is provided with rotatable accessories capable of a massaging action and at the same time acting as a shower head, said accessories being disposed on a handle having the shape of a telephone which can either be seized by the user or hung on the wall of the shower and/or the bathtub, said shower handle being used in replacement of the conventional shower heads.

16 Claims, 14 Drawing Sheets

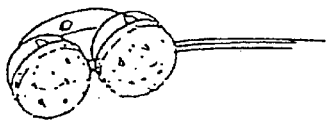
FIG. 7
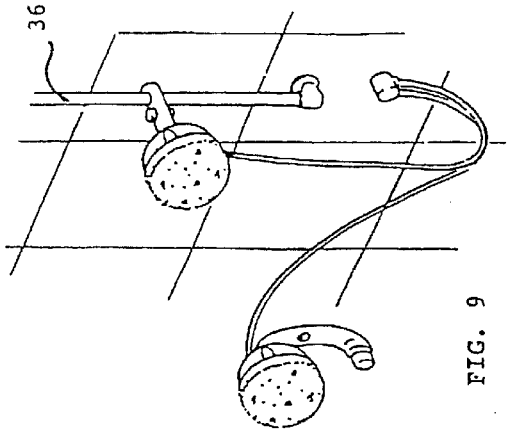
FIG. 8
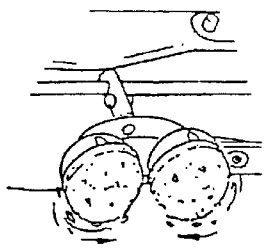
FIG. 9
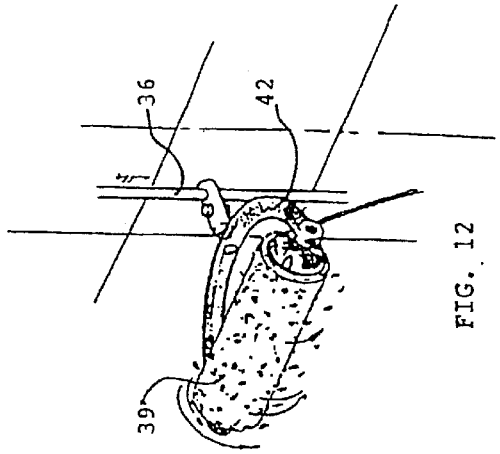
FIG. 10
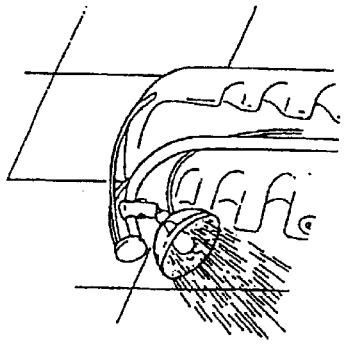
FIG. 11
FIG. 12

HAND-HELD OR FIXED MASSAGE SHOWER

This application is a continuation-in-part of International Application PCT/IT99/00005 filed Jan. 15, 1999, which designated the United States.

The present invention relates to bathroom fixtures and the massotherapy as well as beauty parlour treatments. The same Applicant of the present invention made known fixtures which are an evolution of the traditional fixed shower facilities as they permit a water massage, i.e. relaxing massage and body washing, also of those parts that cannot be easily reached such as back.

It is known from CH-A-0328897, U.S. Pat. Nos. 3,563,469, 4,432,355, DE-A-3827286, U.S. Pat. Nos. 5,385,532, 5,065,463 and DE-U-9402435, water-driven fixtures provided with massaging rotatable accessories with a handle in the shape of a telephone, having a water supply duct for supplying the rotatable accessories themselves. Said documents disclose also means for the quick-coupling and for the quick-release of said accessories.

A disadvantage of these prior art devices is that none of them disclose a device provided with two rotatable accessories that can be used simultaneously in order to give the user a better massaging and/or washing action on his body.

A further drawback of the prior art, consists in that it is not possible to replace one of the rotatable devices without stopping the other one or without closing the water supply of both the rotatable devices.

A first object of the invention is to provide a water massage fixture of the above-mentioned type which can be installed in place of a conventional rose or perforated shower head.

A second object of the invention is to provide a rose or perforated shower head provided with a water massage fixture that makes only use of hydraulic and not electric means for the massage.

A third object of the invention is to overcome the disadvantages of said prior art providing a shower handle in the form of a "telephone" including one or more spouts and one or more sponges, rolls or any interchangeable water-driven massaging means which can be seized by the user and/or hung on the wall or the bathtub.

These and other objects will be more readily understood from the following description with reference to the accompanying drawings which show some preferred embodiments of the invention by way of a not limiting example. In the drawings:

FIGS. 7 and 8 show the use of the fixture of FIG. 1 which is applied to a rod holding the shower head and seized by the user, respectively;

FIG. 9 shows the use of the shower handle provided with only one rotatable brush/head and the hanging of the rotatable brush/head directly to the handle-stand rod;

FIG. 10 shows the interchangeability of the rotatable brush/head with the massaging roll;

FIG. 11 shows a rotatable multispout swivel-head that can also be used as water jet massager;

FIG. 12 shows a further embodiment of the invention consisting of a roll-holder fork support provided with a rotatable interchangeable roll;

Figure 25:
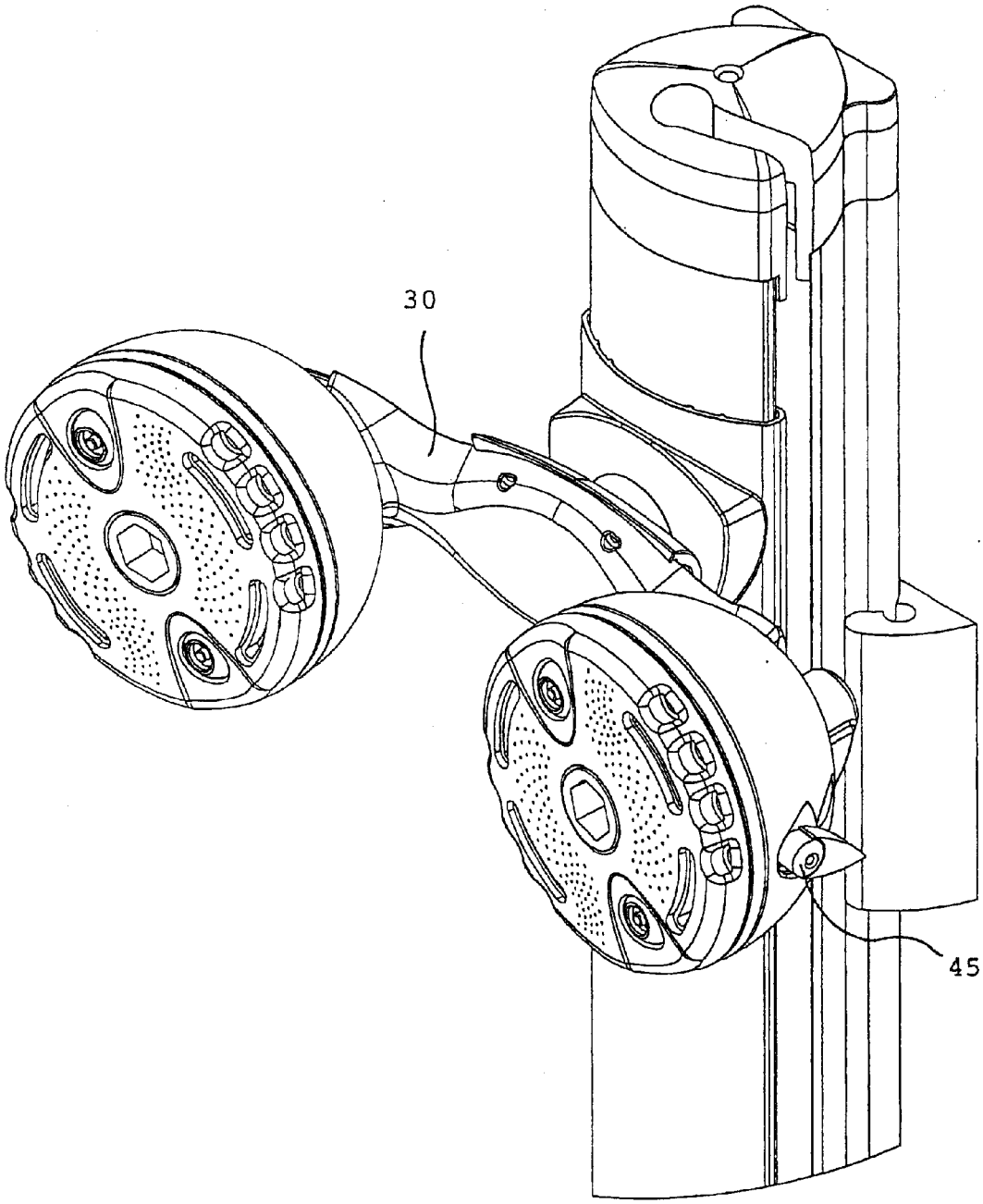

Fig. 25 demonstrates one embodiment of the invention mounted on a device and attached to the device by snapping it into a holding portion of the device.

Figure 24:
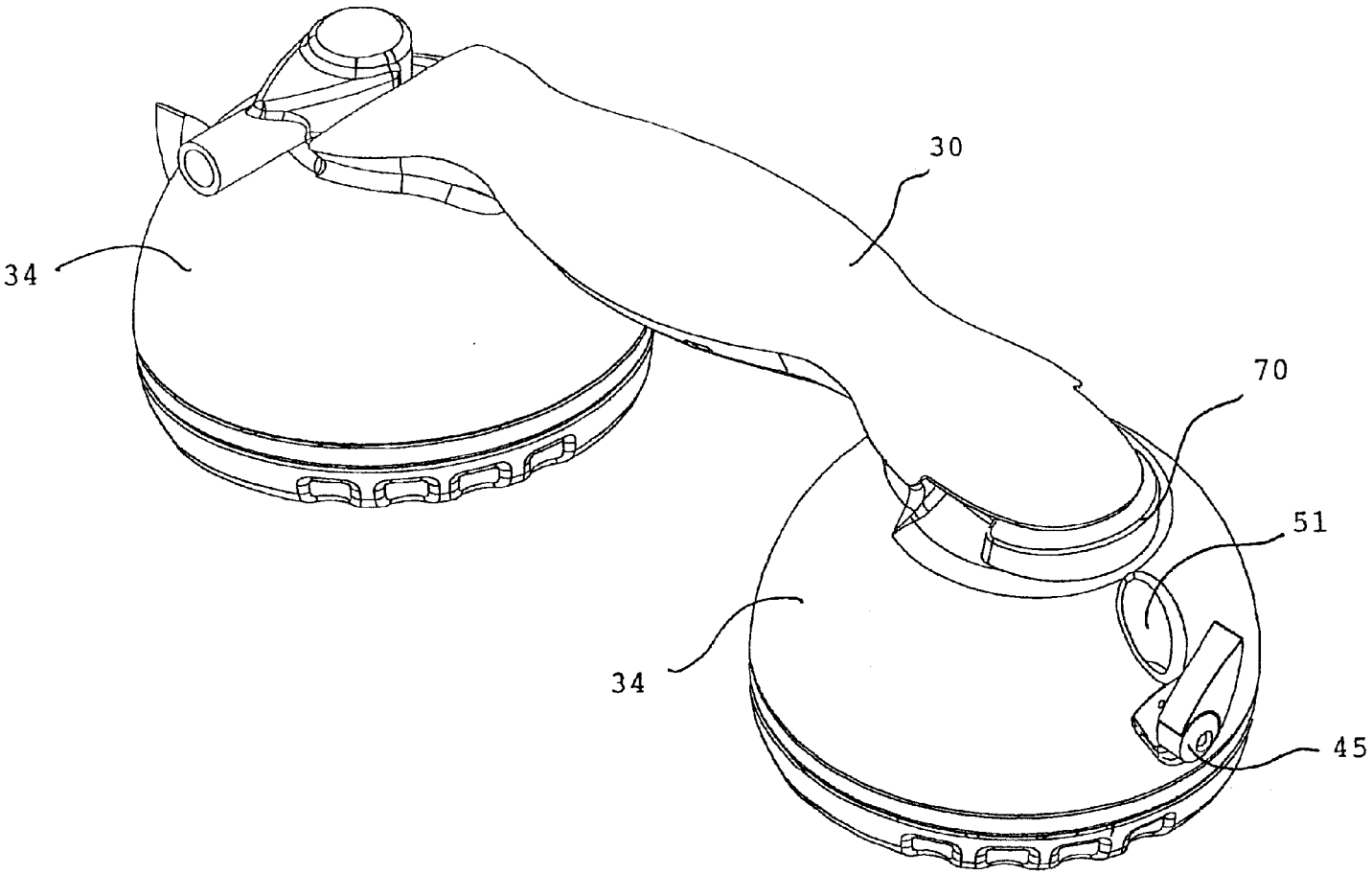
FIGS. 24–25 show perspective views of a further simplified embodiment of the invention.
Figure 26:
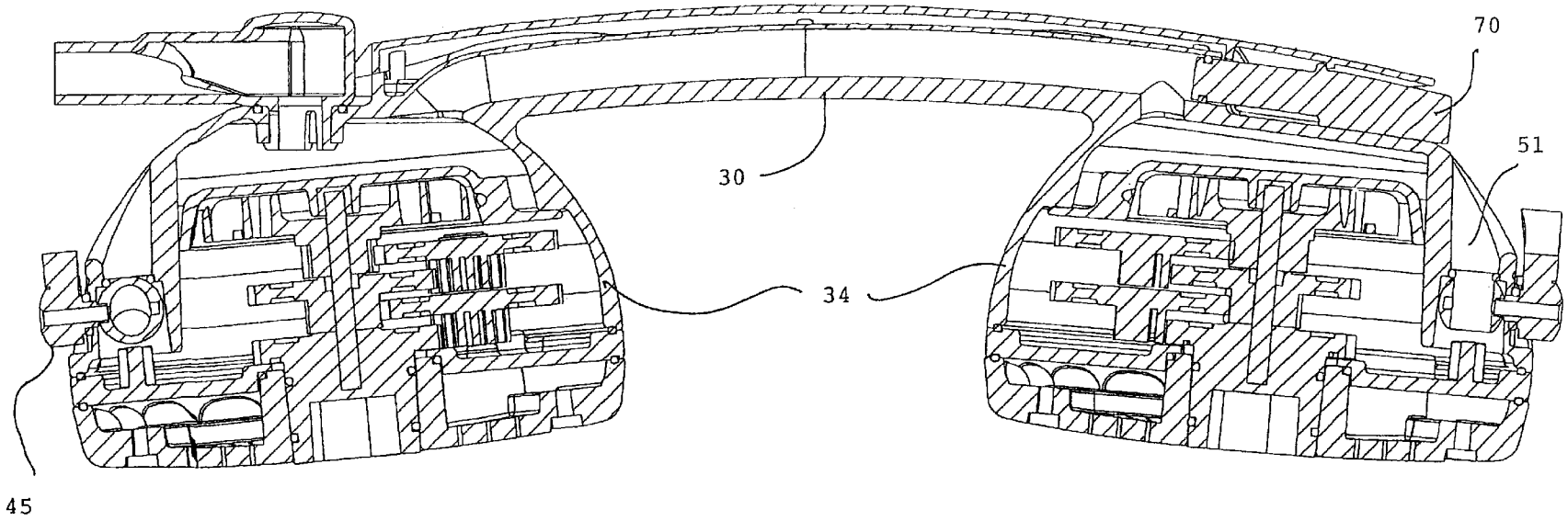
Figure 27:
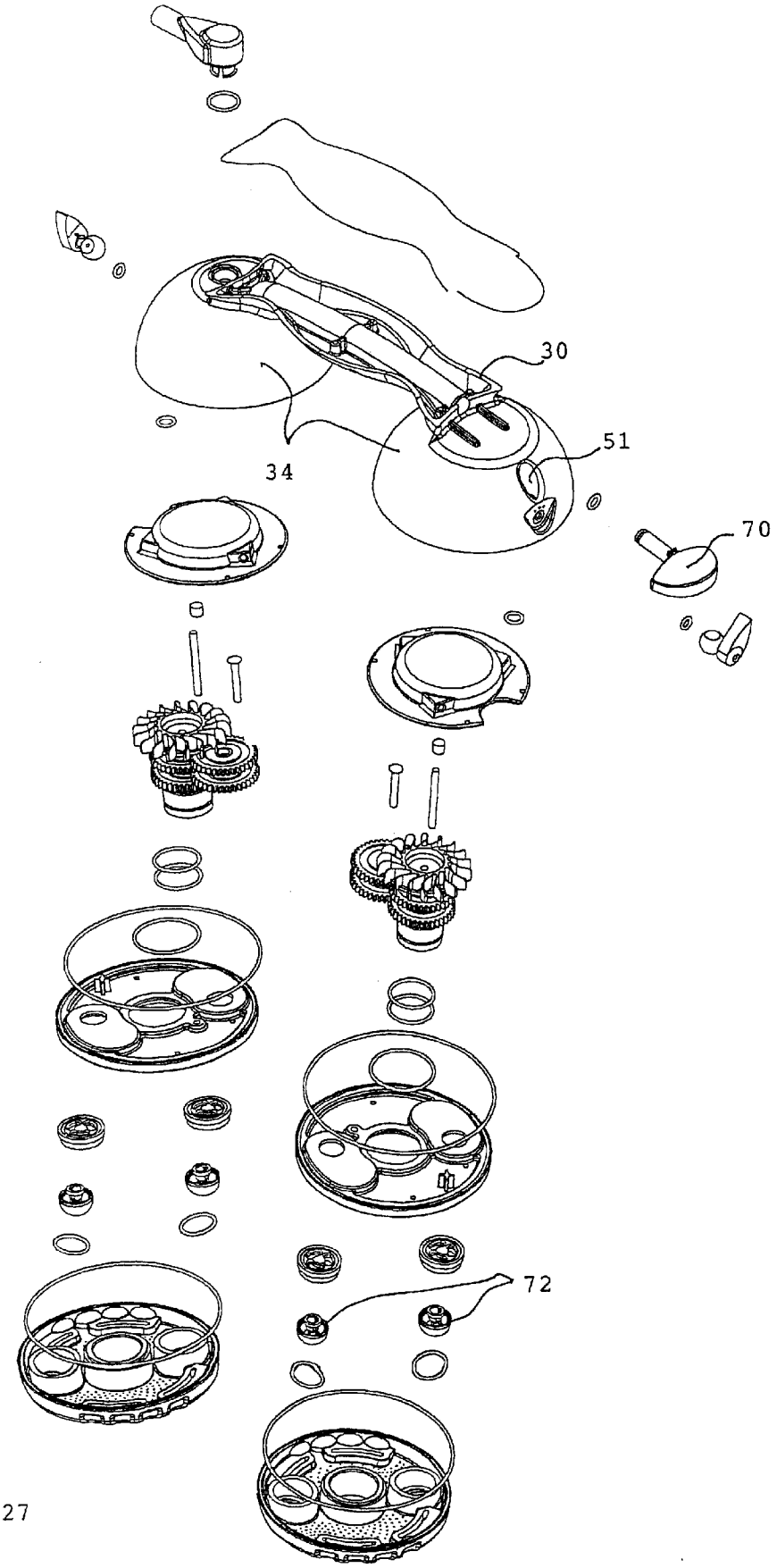

FIG. 26 is a perspective view partially sectioned of the embodiment of FIGS. 24–25;

FIG. 27 is an exploded view of the embodiment of FIGS. 24–26.

With reference to the figures, a peculiar feature of the invention is its application in place of a conventional shower head and/or a shower handle in the form of a telephone.

This is accomplished by providing an advantageously simple water outlet/support structure 30 that allows several rotatable accessories 34 such as sponges, brushes, rolls, discs provided with balls or soft bristles, etc. to be used without needing the installation of particular fixtures and/or special water systems.

In particular each rotatable accessory 34 can be either used individually or in pairs in a practical and easy manner according to user's needs and wishes because of the provision of quick-release means 32–32A actuated by a push button 32B, e.g., a bayonet coupling 32C. To this purpose, a ball valve 52, which automatically closes the water duct when the corresponding rotatable accessory 34 is released by the user, is provided at each quick-release means.

Figure 23:
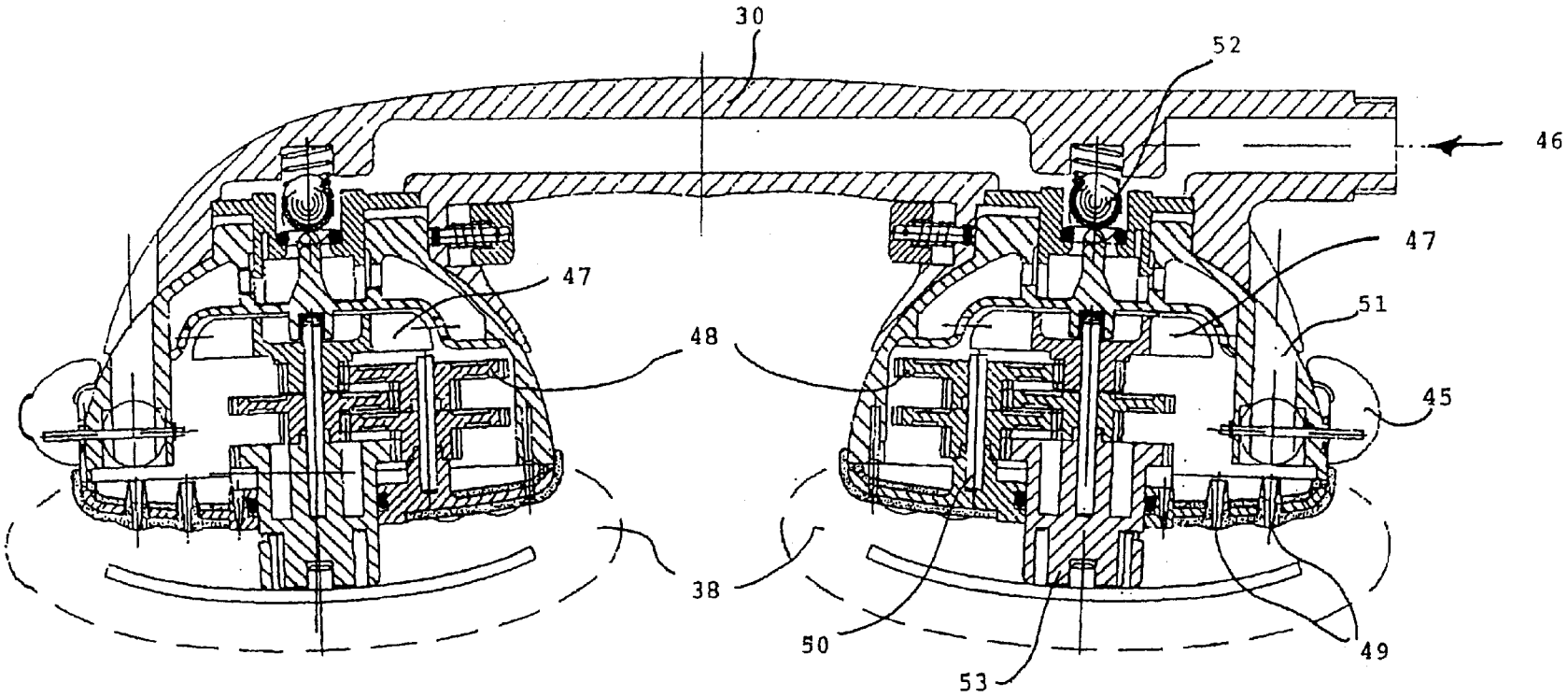
FIG. 23 is a longitudinal section of the shower handle of FIG. 22.

It should be noted that the rotation of the brushes and/or the shower heads or rolls is advantageously caused by the pressure of the water supplying the shower. In the particular embodiment disclosed, the rotation of each brush is caused by an impeller 47 which is driven by the water flow from the hydraulic system. In the section of FIG. 23 there is shown the water flow through inlet 46, the supporting structure 30, the two impellers 47, and the downward outlet of nozzles 49. The rotation movement is transmitted by impeller 47 to the brushes or sponges 38 by means of a gearing consisting of a train of reduction gears 48 idle rotating about their axis.

Figure 22:
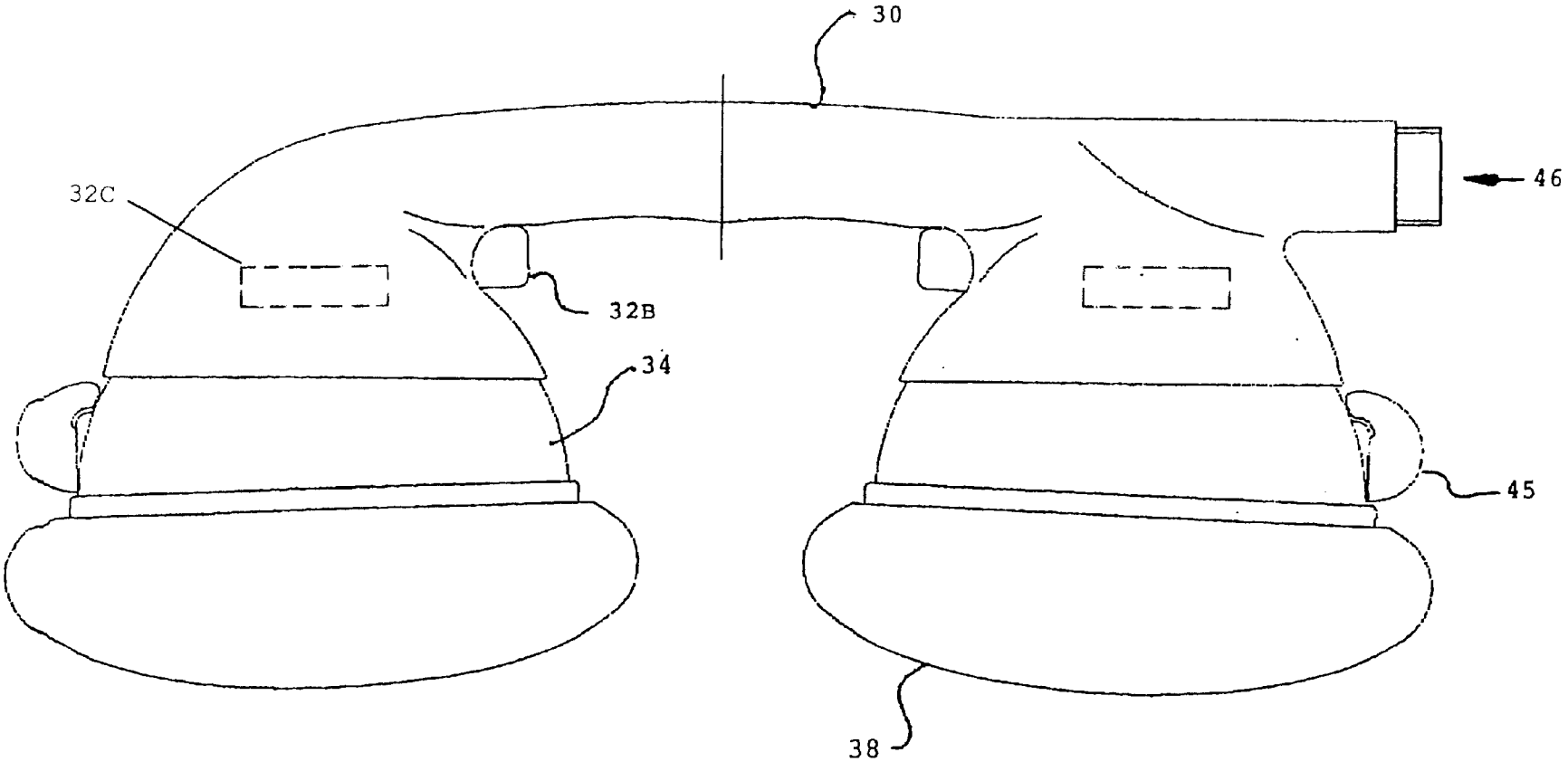
FIG. 22 shows a shower handle provided with two rotatable brushes or sponges similar to FIG. 1 and with outlet water pressure regulating means.

In the embodiment shown in FIGS. 22 and 23 the water-driven rotatable accessories 34 are further provided with taps 45 that regulate the water flow discharged through an additional outlet 51 in order to adjust the pressure and the amount of water flowing through nozzles 49. In this way the amount of the water flowing through the soaped sponges can be advantageously regulated at will.

In fact, the support of brushes or roll 39 needs just to be positioned and directed as desired and after having plugged in the desired rotatable accessory, the water supply tap is opened at the desired temperature and the outlet pressure is adjusted according to the desired rotation rate.

As shown in FIGS. 7–11 the shower handle having the typical shape of a telephone allows either only one or two rotatable bodies to be used. In the latter case one rotatable body can be hung on a rod 36 (FIG. 9), the other is seized by the user. To this end, both rotatable bodies are provided with a water supply inlet. It should be noted that in the present embodiment water is supplied through the above-mentioned quick-release means 32–32A.

Advantageously, if the sponges are removed the rotatable fixture is transformed into a multispout shower head capable of soft rain or stimulating jet.

In particular, there are provided a main central water spout 40 and a plurality of peripheral satellite water spouts 41 capable of being oriented and rotating about their axes and the main water spout. The rotation movements are preferably provided in this case by a water-driven impeller that moves the front portion of the head integral with a plurality of satellite heads rotating about the axis of the impeller. Such satellite heads 41 are also rotated about their own axes by gears engaging to corresponding central stationary gears.

According to another feature of the invention, the fixture is provided with a receptacle containing the foam soap and/or a liquid soap which flows out directly on the sponge by pressing a suitable push button.

Instead of a roll located in place of a sponge 38, a suitable fork support 42 able to hold a roll massaging a wide portion of the body can also be used (FIG. 12). The present invention can advantageously meet most requirements. In fact, as shown in FIGS. 13 to 17, several embodiments characterized by being easy to use are provided. Such embodiments are capable of performing a variety of functions such as a stimulant, tonic water massage, and guarantee the interchangeability of sponges and rolls as well as the capability for the latter of being detached from the support and handled with the maximum comfort.

Figure 18:
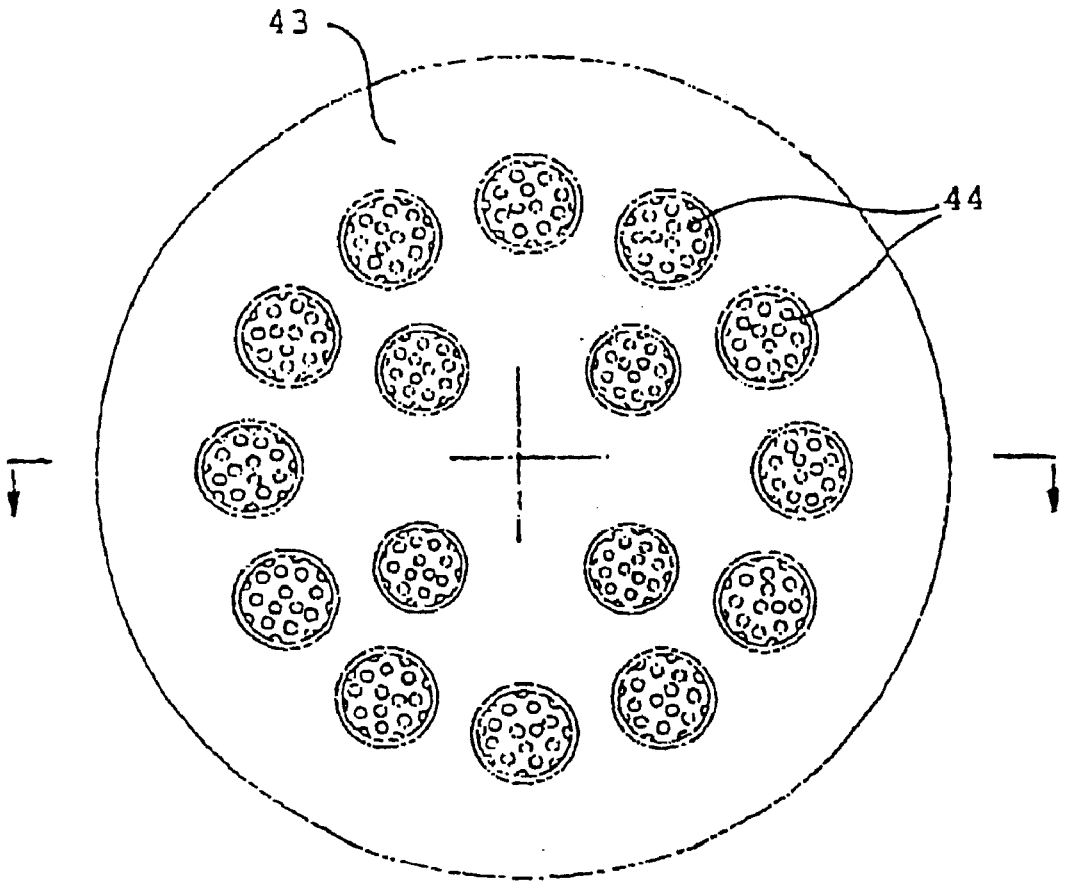
FIGS. 18–19 show a rotatable ball-holder disc to be mounted in place of the sponge to have a body massage.
Figure 19:
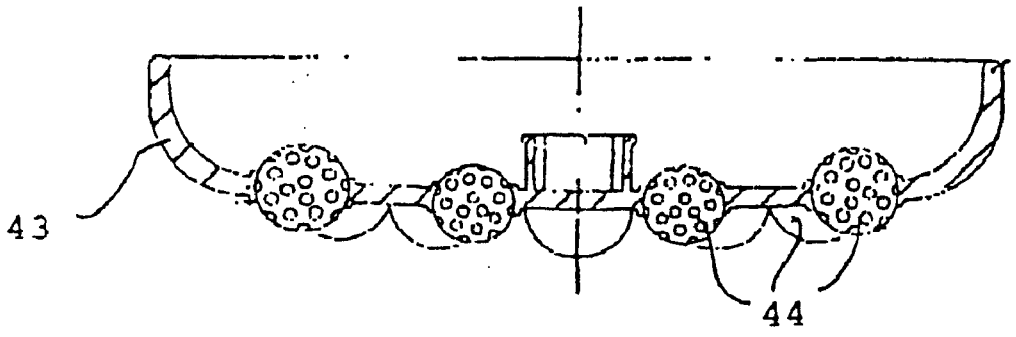

With reference to FIGS. 18 and 19 the rotating sponges can be replaced by rotatable ball-holder discs 43 allowing a particularly effective relaxing massage to be accomplished. More particularly, such rotatable balls 44 are idle mounted and are rotated with respect to their mountings when contacting the user's body. Still another advantage of the invention consists in that it is not necessary to have a shower for using the above-mentioned fixture but the massaging effect can also be enjoyed when having a comfortable bath in a bathtub.

Figure 1:
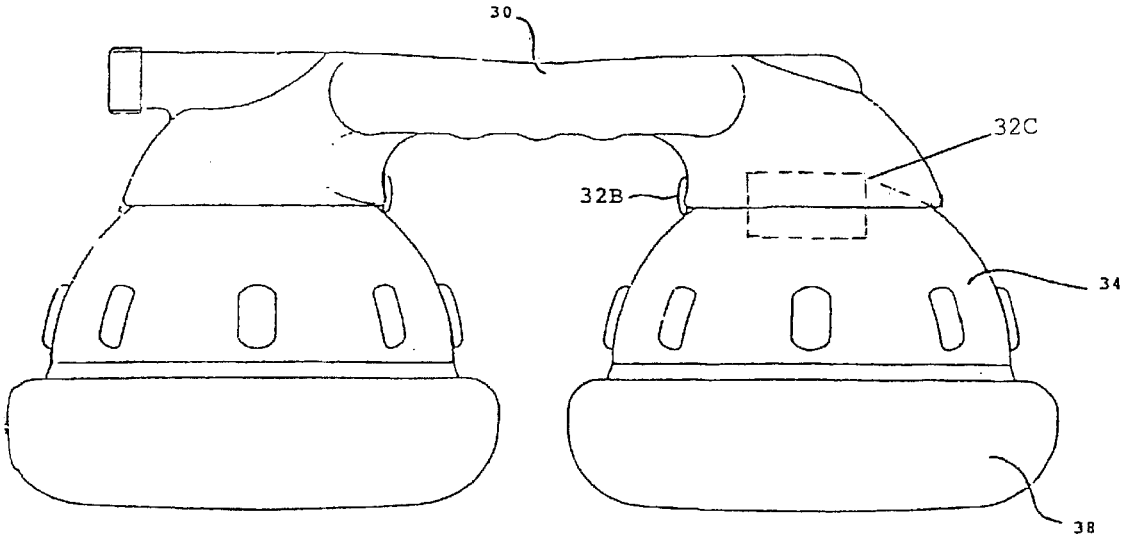
FIG. 1 is an elevation side view of a first embodiment of a shower handle in the form of a "telephone" with two rotatable brushes according to the invention.
Figure 2:
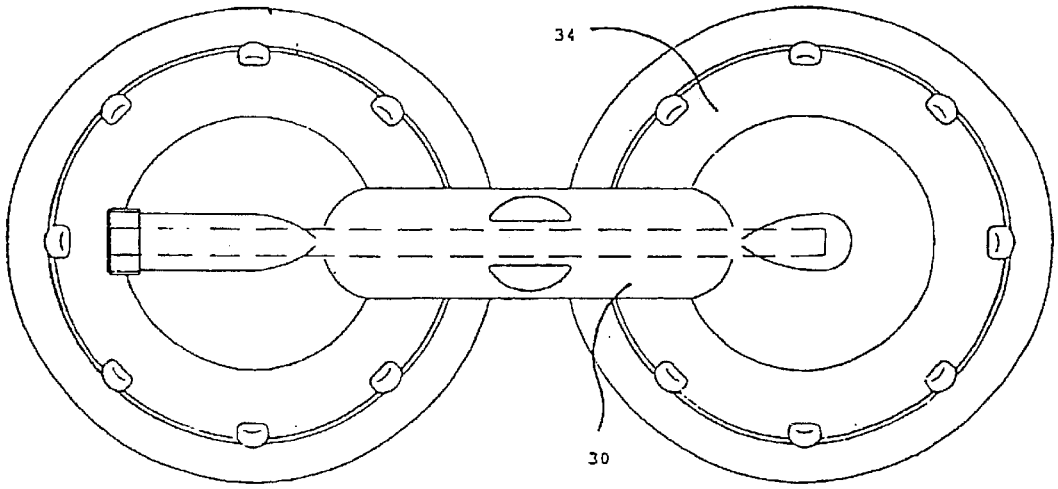
FIG. 2 is a plan view of the shower handle of FIG. 1.
Figure 3:
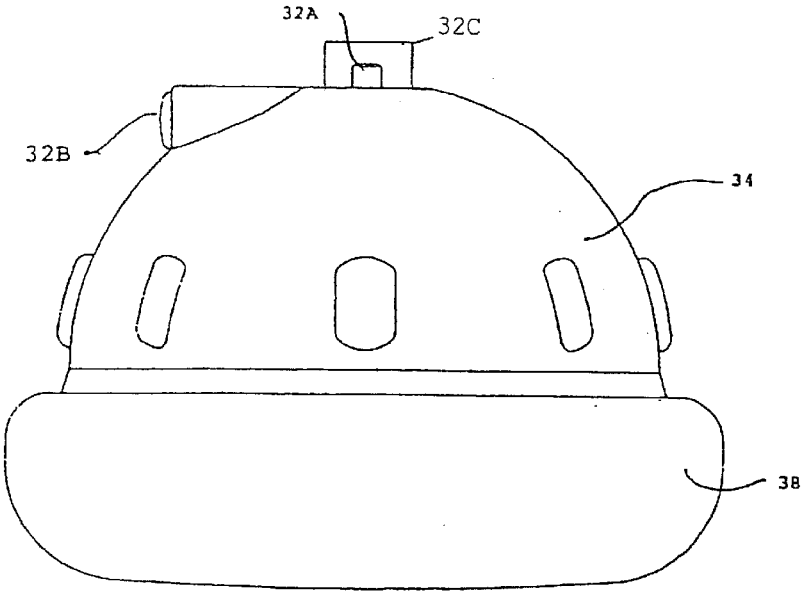
FIG. 3 is an elevation side view of one of the two interchangeable brushes of the shower handle shown in FIG. 1.
Figure 6:
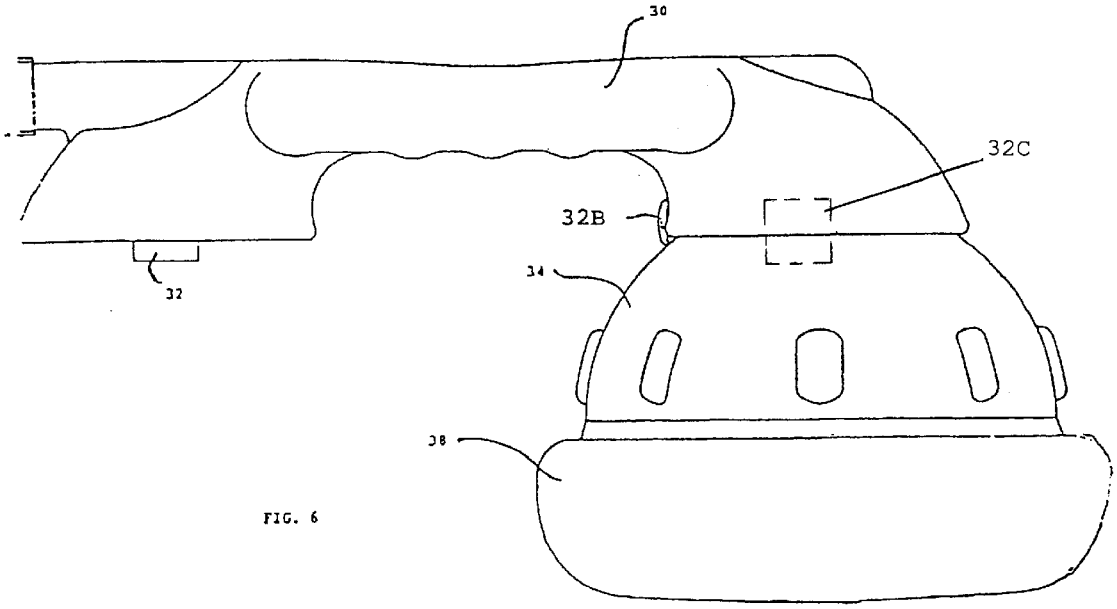
FIG. 6 is similar to FIG. 1 and shows a possible use of the shower handle provided with only one shower head.
Figure 4:
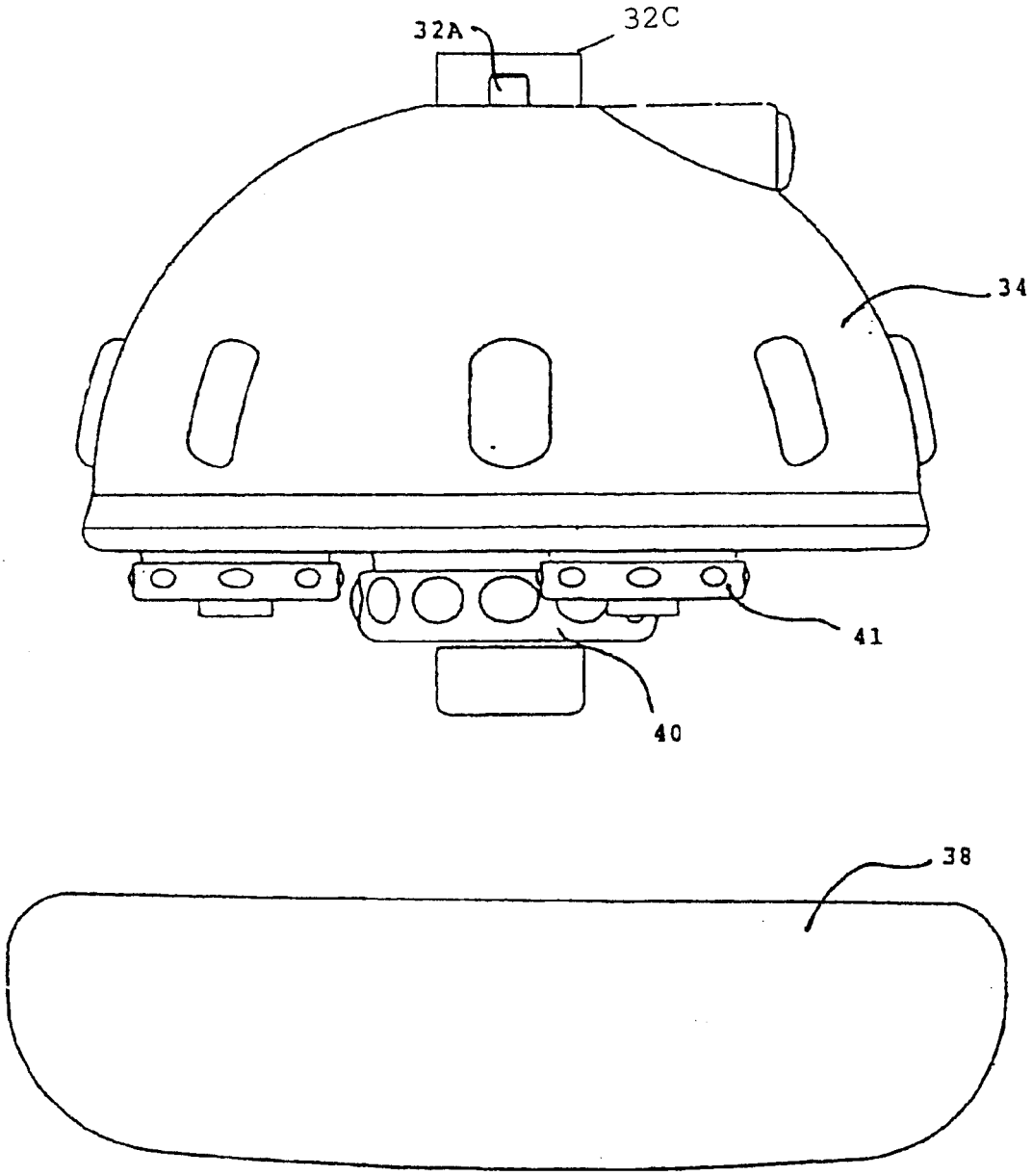
FIG. 4 shows the detail of FIG. 3 in which the sponge is removed from the rotatable multispout shower head.
Figure 5:
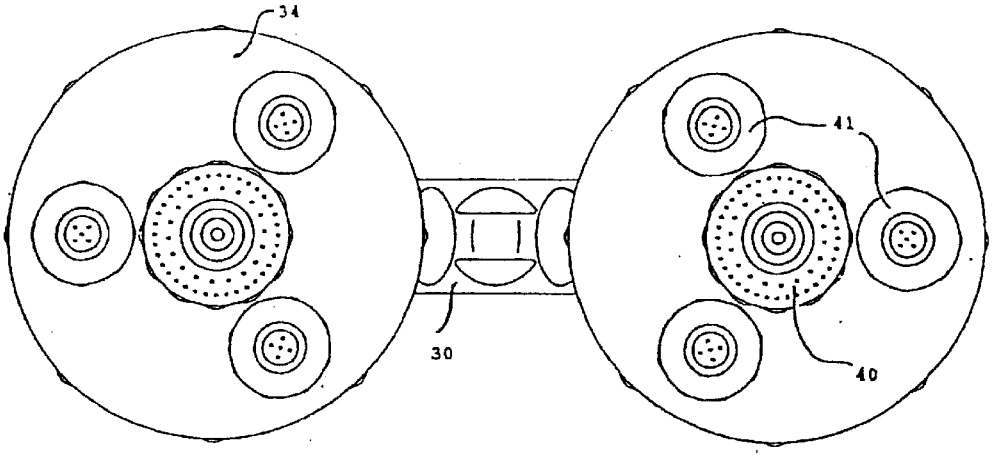
FIG. 5 is a bottom plan view of the rotatable perforated shower head of the shower handle shown in FIG. 1.
Figure 20:
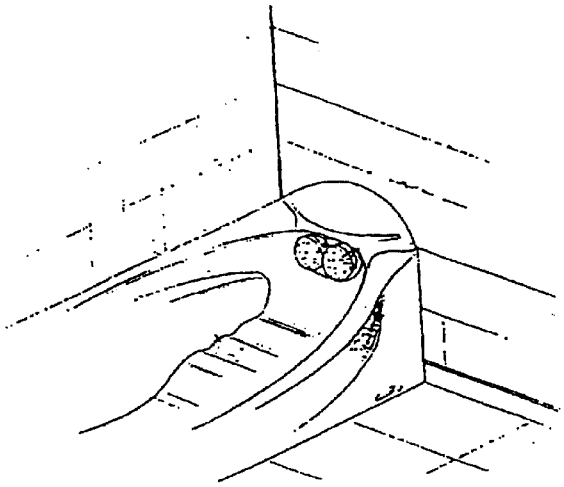
FIGS. 20–21 show two applications of the rotatable brushes and/or roll to a bathtub to have a massage also when having a relaxing bath.
Figure 21:
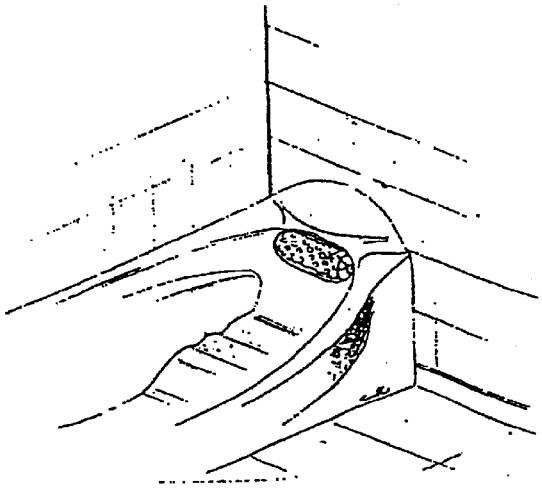
Figure 13:
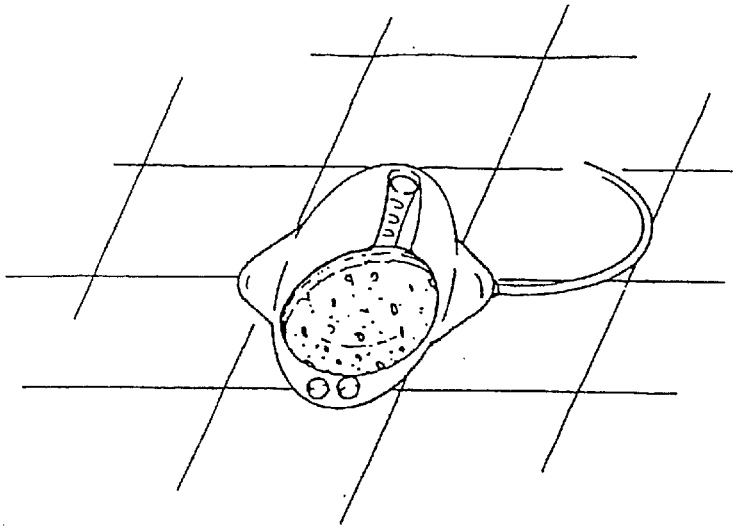
FIG. 13 shows a particular embodiment of the support for a rotatable sponge that can be hung on the wall.
Figure 15:
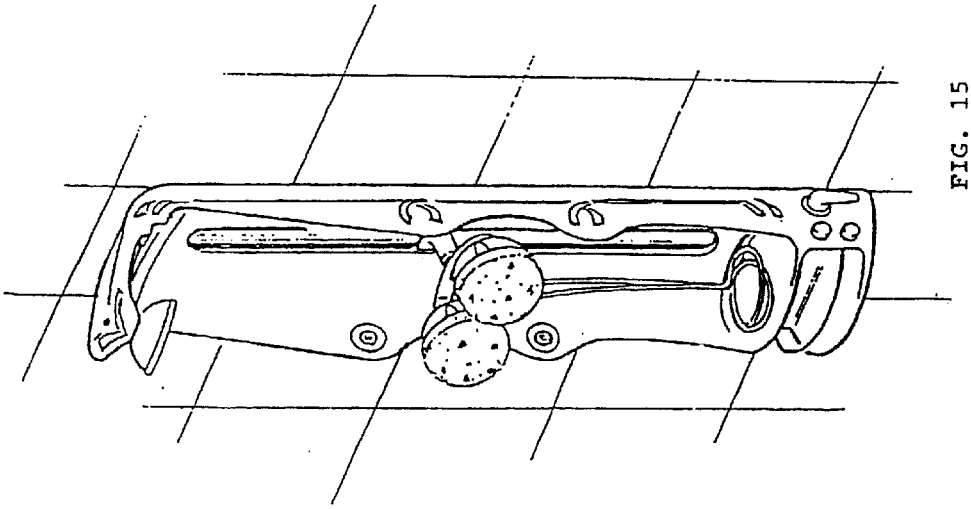
FIGS. 14–17 show several mountings of the invention on rods or fitted columns.
Figure 14:
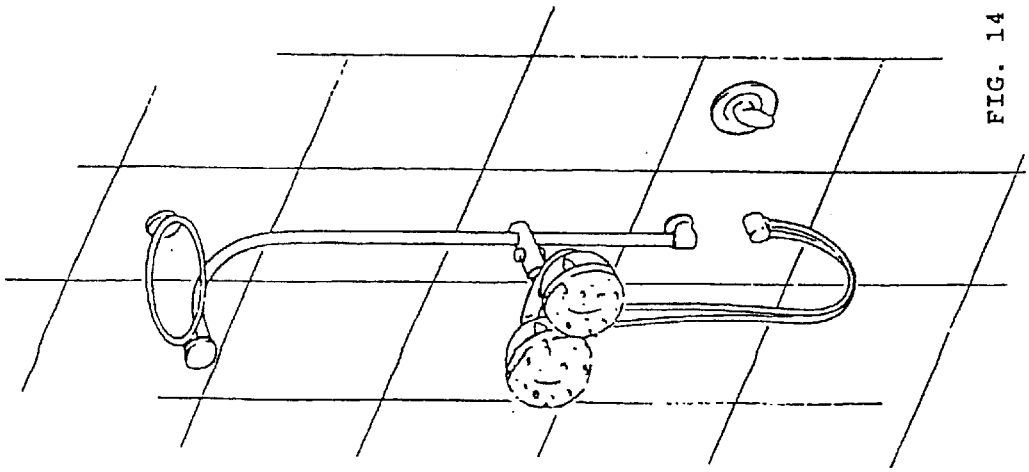
Figure 17:
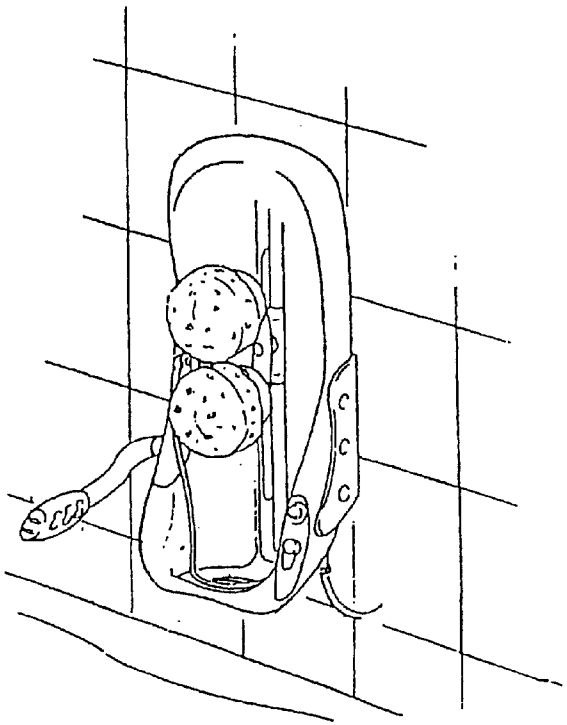
Figure 16:
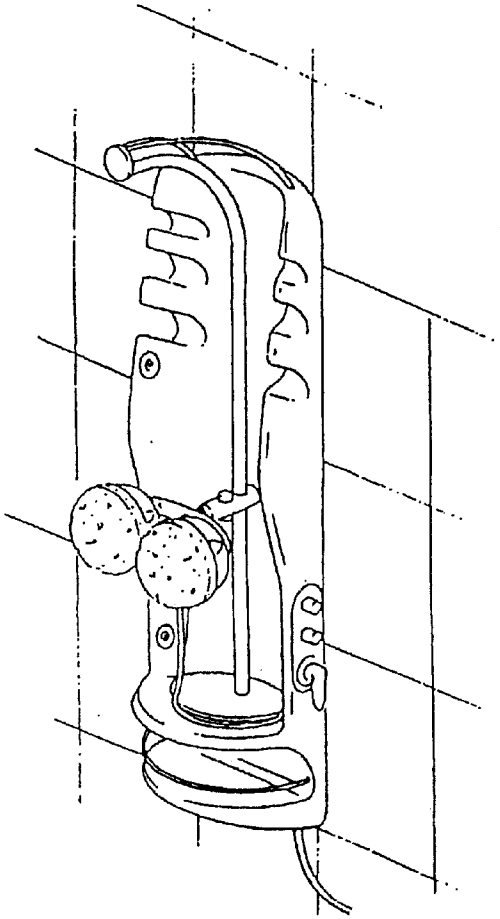

To this end, FIGS. 20 and 21 show an embodiment in which both the sponges and/or rotatable discs and the roll are placed in a bathtub. Advantageously, the bottom and the walls of such bathtub are shaped so as to allow the user to take the desired posture for enjoying as best he can either the relaxing or the stimulant massaging action.

According to a further feature of the invention, each rotatable accessory 34 is connected to support 30 by quick-release couplings 32, 32A, 32B, e.g., bayonet couplings 32C or similar coupling means. Likewise, the interchangeable sponges, brushes or rolls are connected preferably by means of snap couplings 53.

Referring to FIGS. 24–27, a simplified embodiment of the invention provides a shower handle or support 30 in the form of a telephone wherein the rotatable accessories 34 are fixed on the handle or support 30 and are preferably manufactured as one-piece integral with the handle or support itself.

Advantageously, the rotatable sponges, brushes, rolls, discs provided with balls or soft bustles are interchangeable on said rotatable accessories 34. This simplified embodiment is provided with closing means 70 suitable to stop the water supplying of one of the two rotatable accessories 34, in this way increasing the water pressure and/or the water flow rate in the other rotatable accessory. Such increase produces a higher hydro-massage capability of this latter rotatable accessory.

According to the present invention, said closing means 70 of the water supply of one of the rotatable accessories 34 are preferably constituted by a sliding sluice-gate, provided on the handle 30*a,* that closes the supply conduit of the rotatable accessory itself. Furthermore, also in this simplified embodiment of the invention, on one or both rotatable accessories 34 it is possible to provide ball taps 45 (as previously disclosed) specifically intended to regulate the water flow discharged through an additional outlet 51 in order to adjust the pressure and the amount of water flowing to the sponges 38, the brushes or rolls 39. Such feature is particularly advantageous during the soaping operations with soap or with bubble-bath, in order to slow-down the washing of the sponges 389, the brushes or rolls 39.

Finally, the nozzles 72 by which the water gets out from the rotatable accesories 34, can be turned according to different directions.

It is useful underline that, as clearly showed in FIG. 7, said rotatable accessories 34 counter-rotate so as to better carry out their massaging action.

The present invention has been described and illustrated according to preferred embodiments thereof, however, it should be understood that those skilled in the art can make equivalent modifications and/or replacements without departing from the scope of the present industrial invention.

What is claimed is:

1. An improved water-driven fixture for having a water massage and/or a shower provided with rotatable accessories (34), capable of a massaging action and at the same time acting as a shower head, that are disposed on a handle (30) having the shape of a telephone including a water supply duct for supplying the rotatable accessories (34), characterized in that said rotatable accessories are two and said shower handle is used in replacement of the conventional shower heads and it can either be seized by the user or hung on the wall of the shower and/or the bathtub; said two rotatable accessories (34) being connected by means of quick-release couplings (32, 32A) for their fast replacement, that are provided with individual supply water inlets, a ball valve (52) capable of automatically closing the water duct when the corresponding rotatable accessory (34) is released by the user being also provided at each quick-release means coupling (32).

2. The water-driven fixture for having a water massage and/or a shower of claim 1, characterized in that said rotatable accessories consist of a shower heads on which interchangeable sponges (38), brushes or rolls (39) for water massage are disposed.

3. The water-driven fixture for having a water massage and/or a shower of claim 1, characterized in that said heads are rotatable and include a plurality of spouts.

4. The water-driven fixture for having a water massage and/or a shower of claim 3, characterized in that said spouts consist of a main central spout (40) and two or more peripheral spouts (41) rotating about their own axes and about the axis of main spout (40).

5. The water-driven fixture for having a water massage and/or a shower of claim 1, characterized in that rotatable ball-holder discs (43) are provided in place of said interchangeable rolls (39) or brushes, said balls (44) being freely rotated with respect to their own housings when contacting the user's body.

6. The water-driven fixture for having a water massage and/or a shower of claim 1, characterized in that each rotatable accessory (34) has its own supply water inlet.

7. The water-driven fixture for having a water massage and/or a shower of claim 1, characterized in that said quick-release couplings allowing also only one rotatable accessory fitted in the shower handle to be used while the other accessory can be hung on the wall.

8. The water-driven fixture for having a water massage and/or a shower of claim 1, characterized in that it is used in a bathtub having a wall provided with a suitable housing able to receive said rotatable accessories of any type (roll, brush or sponge).

9. The water-driven fixture for having a water massage and/or a shower of claim 1, characterized in that the water-driven rotatable accessories (34) are provided with ball taps (45) that regulate the water flow discharged through an additional outlet (51) in order to adjust the pressure and the amount of water flowing through nozzles (49).

10. The water-driven fixture for having a water massage and/or a shower of claim 1 characterized in that water flows into the rotatable accessories (34) through an inlet (46), reaches each impeller (47) through support (30) and flows out of nozzles (49), the rotation movement being transmitted from the impeller to the brushes or sponges (38) by means of a gear train including an idle reduction gear train (48) on its own axis (50).

11. The water-driven fixture for having a water massage and/or a shower of claim 1, characterized in that, the quick-release couplings are bayonet couplings.

12. The water-driven fixture for having a water massage and/or a shower of claim 1, characterized in that said interchangeable sponges, brushes or rolls are connected by means of snap couplings (53).

13. The water-driven fixture for having a water massage and/or a shower of claim 1, characterized in that said rotatable accessories (34) are fixed on the shower handle (30) and, in order to increase the water pressure and/or the water flow in of one of said two rotatable accessories (34), in the other rotatable accessory are also provided closing means (70) of its water supply conduct.

14. The water-driven fixture for having a water massage and/or a shower of claim 13, characterized in that said closing means (70) of the water supply conduct of one of said rotatable accessories (34) are constituted by a sliding sluice-gate, provided on the handle (30), that closes the supply conduit of the rotatable accessory itself.

15. The water-driven fixture for having a water massage and/or a shower of claim 14, characterized in that the water-driven rotatable accessories (34) are provided with ball taps (45) that regulate the water flow discharged through an additional outlet (51) in order to adjust the pressure and the amount of water flowing to the sponges (38), the bruses or rolls (39).

16. The water-driven fixture for having a water massage and/or a shower of claim 1, characterized in that said rotatable accessories (34) counter-rotate.

* * * * *